US006513739B2

(12) United States Patent
Fritz et al.

(10) Patent No.: US 6,513,739 B2
(45) Date of Patent: Feb. 4, 2003

(54) POWERED FOUR SIFTER ASSEMBLY

(76) Inventors: Eula C. Fritz, 1921 Claudina Ave., Los Angeles, CA (US) 90016; Wanda C. Fritz, 1921 Claudina Ave., Los Angeles, CA (US) 90016

( * ) Notice: Subject to any disclaimer, the term of this patent is extended or adjusted under 35 U.S.C. 154(b) by 67 days.

(21) Appl. No.: 09/819,919

(22) Filed: Mar. 29, 2001

(65) Prior Publication Data

US 2002/0139879 A1 Oct. 3, 2002

(51) Int. Cl.[7] ..... B02C 19/00

(52) U.S. Cl. ..... 241/73; 209/236; 241/24.26; 241/101.8

(58) Field of Search ..... 209/235, 236; 241/24.1, 24.26, 24.21, 73, 79.2, 101.8, 189.1

(56) References Cited

U.S. PATENT DOCUMENTS 4,271,011 A * 6/1981 Spencer et al. ..... 209/236
5,178,335 A * 1/1993 Mertens ..... 241/73
5,839,674 A * 11/1998 Ellis ..... 241/73

* cited by examiner

*Primary Examiner*—W. Donald Bray
(74) *Attorney, Agent, or Firm*—Erik M. Arnhem

(57) ABSTRACT

A flour sifter includes a sifter unit detachably supported on a stand that houses an electric motor and speed reducer. The speed reducer output shaft has a disconnectable connection with an agitator shaft that extends transversely within the sifter tube, such that when the motor is energized the agitator is rotated to pulverize flour particles located on a sifter screen in the sifter tube. Flour particles gravitate through screen openings into a collection receptacle placed below the sifter tube. The sifter unit can be removed from the stand for cleaning or storage.

6 Claims, 3 Drawing Sheets

POWERED FOUR SIFTER ASSEMBLY

FIELD OF THE INVENTION

This invention relates to a flour sifter assembly, and particularly to a flour sifter that is powered by an electric motor.

BACKGROUND AND SUMMARY OF THE INVENTION

It is known that flour used for baking purposes can be ground to a finer consistency by passing the flour though a hand-powered sifter implement. Typically, the sifter implement includes a tube having a semi-spherical screen therein, and a rotary agitator located within the tube for exerting a grinding action on flour particles resting on the screen surface.

The agitator has four or more arcuate bars (or blades) that scrape along the screen surface so as to pulverize the flour particles and propel such particles through the screen openings.

Commonly, the rotary agitator is powered by an external crank that is hand-operated. The person holds the sifter tube in one hand while operating the hand crank with the other hand, such that the flour is pulverized as it gravitates downwardly through the tube.

One problem with-the conventional flour sifter is that the person is required to use both hands to operate the sifter. It is not possible to add new flour to the tube while the hand crank is being operated (since one hand is required to hold the tube while the other hand is operating the crank).

The present invention proposes a flour sifter wherein the agitator is powered by an electric motor. This is advantageous in that the person can pour new flour into the sifter tube while the agitator is in operation. In preferred practice of the invention, the flour sifter unit is supported in a stabilized position on a support stand while the agitator is running. The sifted flour is deposited directly into a receptacle placed below the sifter tube, without any misdirection of the flour into the area surrounding the receptacle. With conventional hand-held flour sifter units, there is a danger that the person! will inadvertantly move the sifter tube laterally so that some of the flour spills onto the counter surface, rather than gravitating into the receptacle placed on the counter surface.

A further advantage of the motor-powered sifter is that no human effort is required to rotate the agitator. The sifting operation is performed automatically, without need for any special manipulative skill on the part of the human operator.

Further features and advantages of the present invention will be apparent from the attached drawings and description of an illustrative embodiment of the invention.

DESCRIPTION OF A PREFERRED EMBODIMENT OF THE INVENTION

Figure 2:
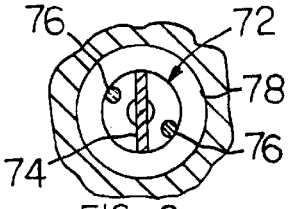
FIG. 2 is a fragmentary sectional view taken on line 2—2 in FIG.1.

Referring to FIGS. 1 through 4, there is shown a flour sifter assembly embodying features of the invention. Some variations in structural detail and structural arrangement can be employed while still practicing the invention. The drawings are illustrative of the inventive concept.

The illustrated flour assembly includes a flour sifter unit 10 detachably supported on a support stand 12, such that the sifter unit can be removed whenever necessary, e.g. to clean the sifter unit or the support stand.

Flour sifter unit 10 includes a cylindrical tube 14 having an upper open end 16 and a lower open end 18. A hemispherical sifter screen 20 is supported within tube 14 near the tube lower end.

Disposed above screen 20 is a rotary agitator 22, that includes a shaft 24 rotatable around a horizontal axis 26, and plural arcuate agitator blades 28 having their ends secured to the shaft near the inner surfaces of tube 14. In the illustrated flour sifter unit the agitator has four blades 28; however a different number of blades can be used. .

Agitator blades 28 are configured so that when shaft 24 is rotated the agitator blades will successively scrape along the upper surface of screen 20 to pulverize flour particles on the screen surface. The finer particles fall through the screen openings into space 29 below tube 14. Prior to operation of the sifter unit, a receptacle (not shown) is placed in space 29 to receive the pulverized flour particles.

If desired, flour,sifter unit 10 can be equipped with a hinged lid on the upper end of sifter tube 14, to preclude contamination of the flour in the tube. Such a lid is not essential for operation of the sifter unit.

Figure 1:
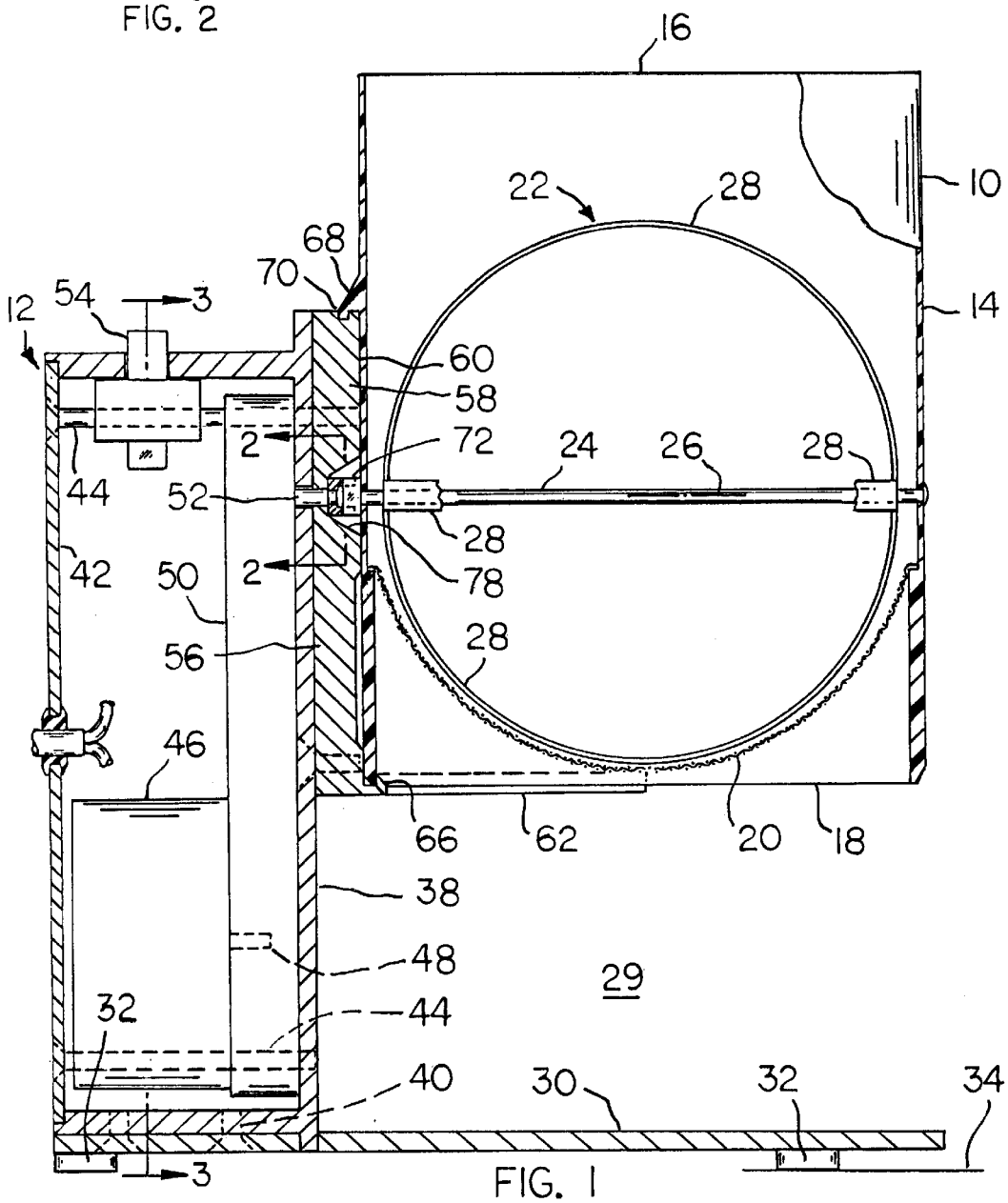
FIG. 1 is a sectional view taken through a motor-operated flour sifter assembly embodying the present invention.
Figure 3:
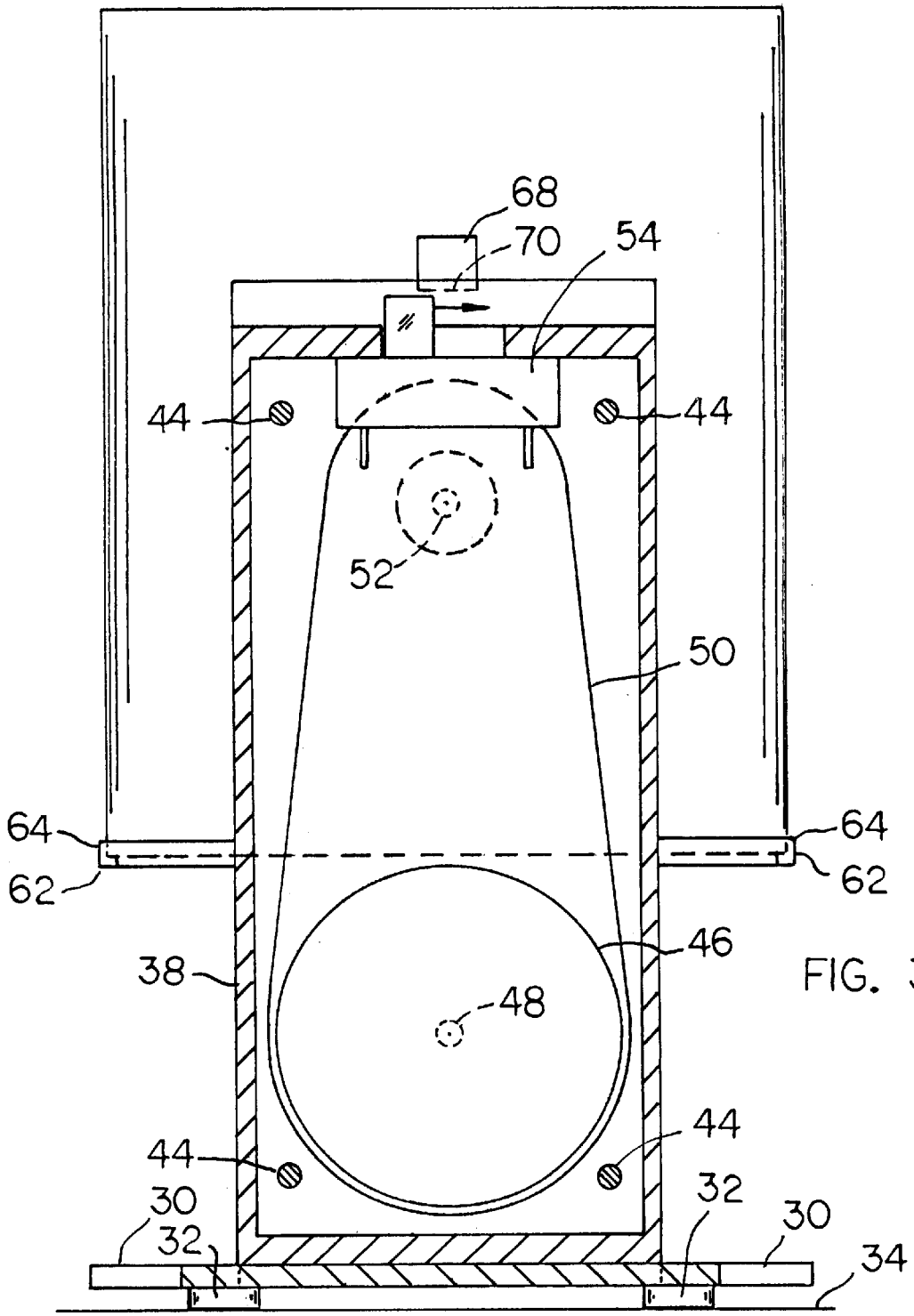
FIG. 3 is a sectional view taken on line 3—3 in FIG.1.

As shown in FIG. 1, flour sifter unit 10 is supported in a stationary (stabilized) position on support stand 12. The stand includes a flat horizontal plate 30 having four rubber feet 32 for fixed positionment of the stand on a counter top surface 34. A hollow upright housing 38 is secured to plate 30 by means of screws 40. The housing preferably includes a removable access plate 42 held in place by screws 44.

Located within housing 38 is an electric motor 46 having a horizontal axis drive shaft 48 extending into a speed reducer unit 50. The speed reducer unit has a horizontal axis output shaft 52 that is driven at a relatively low rotational speed (compared to the motor shaft speed) by means of spur gearing within the speed reducer unit. Typically, the rotational speed of output shaft 52 is on the order of seventy five revolutions per minute. Motor 46 is turned on or off by means of a conventional manual switch 54 suitably mounted on the upper wall of housing 38.

Figure 4:
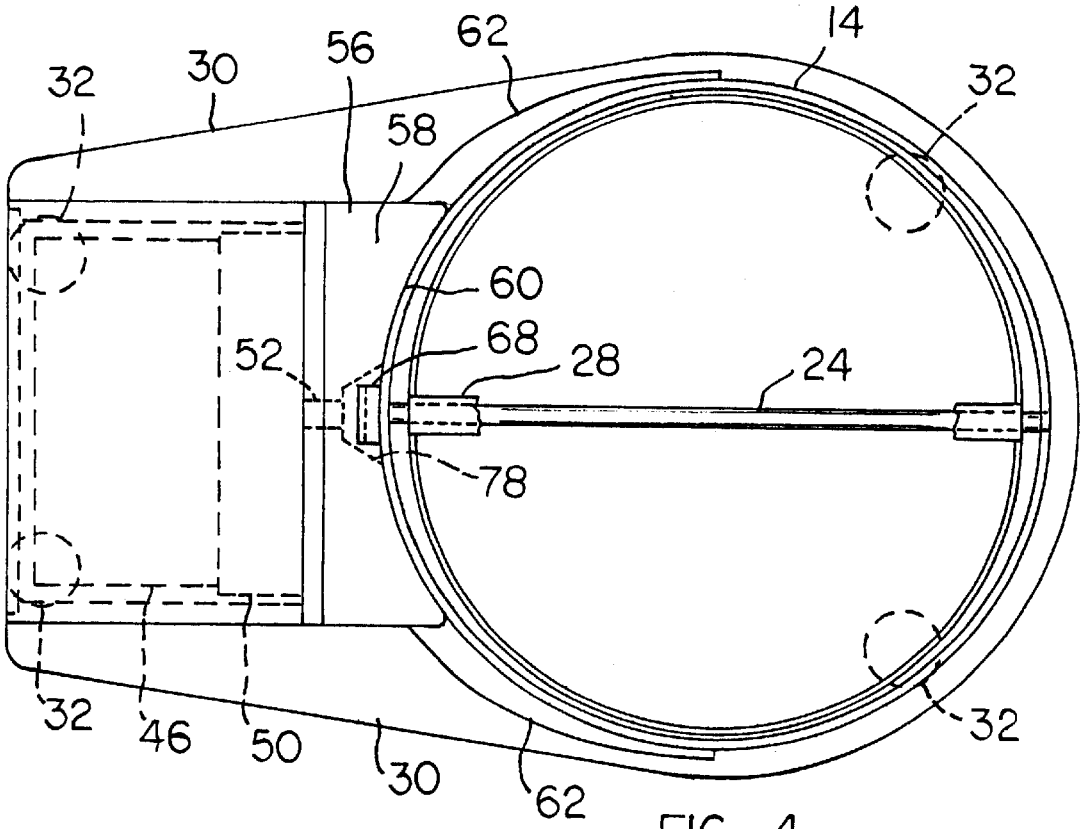
FIG. 4 is a top plan view of the flour sifter assembly depicted in FIG.1.

Housing 38 carries a cradle 56 that serves as the support means for flour sifter unit 10. Cradle 56 includes an upright wall 58 having a concave cylindrical surface 60 adapted to form a seating surface for the cylindrical side wall of sifter tube 14. As shown in FIG. 4 concave surface 60 closely follows the curvature of the tube 14 side wall, so that the tube is stabilized in the lateral plane.

The weight of sifter tube 14 is borne by a semi-circular wall 62 that is adapted to underlie the lower edge of the sifter tube. Wall 62 is an arcuate wall extending along the lower edge of tube 14, without protruding appreciably into the tube opening. As shown in FIG. 4, arcuate wall 62 extends from cradle wall 58 in opposite directions so as to provide a support ledge along approximately one half the circumference of tube 14. Wall 62 has an upstanding lip 64 that tends to prevent sifter tube 14 from sliding laterally from its supported position.

As shown in FIG. 1, the portion of wall 62 proximate to cradle wall 58 has an upstanding lip 66 that seats against the inner surface of the tube 14 side wall, thereby preventing any lateral shift of the tube in the plane of FIG. 1. The sifter tube has an external hook 68 adapted to extend into a groove (or notch) 70 in the upper edge of cradle wall 58, whereby the sifter unit is prevented from toppling off the support stand. The sifter unit is firmly and stably positioned on cradle 56, while at the same time being easily removed, when necessary, e.g. for storage or for washing.

Agitator shaft 24 is detachably connected to shaft 52 by means of a detachable connection 72. As shown in FIGS. 1 and 2, the detachable connection includes a spade or paddle-shaped member 74 extending from shaft 24 and two circular pins 76 extending from shaft 52. When sifter unit 10 is positioned on cradle 56 the two pins 76 straddle spade member 74, to transmit a rotary drive force from shaft 52 to shaft 14. When sifter unit 10 is lifted from cradle 56, space member 74 sesarates from the space between drive pins 76.

Drive connection 72 (i.e. elements 74 and 76) is located within a frusto-conical depression 78 formed in cradle surface 60. The drive connection 72 is functional, without disturbing the tube-seating action of cradle surface 60.

In use of the illustrated apparatus, the sifter unit 10 is positioned on support stand by manipulating tube 14 so that its lower edge seats on arcuate wall 62, while hook 68 extends into notch 70. Switch 54 is turned to the "on" condition, whereby motor 46 is energized to cause shaft 52 to rotate at a controlled rotational speed, e.g. seventy five revolutions per minute.

Flour is poured into the upper end of sifter tube 14 for pulverization by agitator blades 28. The sifted flour is discharged from the lower end of tube 14 into a receptacle positioned on plate 30.

Advantageously, the sifter unit is in a stationary position while agitator blades 28 are rotating. Therefore, all of the sifter flour is directed into the subjacent receptacle, without spillage. The person has both hands free, so that raw flour can be poured into sifter tube 14 while motor 46 powers the agitator.

What is claimed:

1. A powered flour sifter assembly comprising:

a support stand adapted for upright positionment on a counter top surface;

an electric motor located within said stand;

a speed reducer means connected to said motor within said stand; said speed reducer means having an output shaft adapted to run at a substantially lower speed than the motor;

a flour sifter unit detachably supported on said stand; said flour sifter unit comprising a tube having an open upper end and an open lower end, whereby flour can migrate downwardly through the tube during a flour sifting operation; and rotary agitating means within said tube for exerting a grinding action on downflowing flour particles; said agitating means comprising a drive shaft having a detachable connection with the output shaft of the speed reducer means whereby the flour sifter unit can be removed from the support stand.

2. The flour sifter assembly of claim 1, wherein said support stand comprises a receptacle-support plate, and a cradle located above said plate for supporting the flour sifter tube in an elevated position, whereby the sifted flour can gravitate from the tube into a receptacle placed on said plate beneath the tube.

3. The flour sifter assembly of claim 2, wherein said cradle comprises a semi-circular wall adapted to underlie the lower end of said flour sifter tube, whereby the tube is stabilized when said agitating means is rotating.

4. The flour sifter assembly of claim 3, wherein said flour sifter tube has an external hook adapted to engage said cradle for preventing the tube from toppling off the support stand.

5. The flour sifter assembly of claim 3, wherein said flour sifter tube has a cylindrical side surface; said cradle having an upright concave cylindrical surface adapted to seat against the tube side surface for stabilizing the tube on the stand.

6. The flour sifter assembly of claim 5, and further comprising a depression in the concave cylindrical surface of said cradle; said detachable connection being located within said depression when the flour sifter unit is supported on said stand.

* * * * *